US009941030B2

(12) United States Patent
Williamson

(10) Patent No.: US 9,941,030 B2
(45) Date of Patent: Apr. 10, 2018

(54) ELECTROMAGNETIC AND ANTI-BALLISTIC SHIELD CABLE

(71) Applicant: Aetna Insulated Wire LLC, Virginia Beach, VA (US)

(72) Inventor: Richard Williamson, Chesapeake, VA (US)

(73) Assignee: Marmon Utility LLC, Milford, NH (US)

( * ) Notice: Subject to any disclaimer, the term of this patent is extended or adjusted under 35 U.S.C. 154(b) by 0 days.

(21) Appl. No.: 15/136,434

(22) Filed: Apr. 22, 2016

(65) Prior Publication Data

US 2016/0314872 A1 Oct. 27, 2016

Related U.S. Application Data

(60) Provisional application No. 62/151,153, filed on Apr. 22, 2015.

(51) Int. Cl.
*H01B 7/18* (2006.01)

(52) U.S. Cl.
CPC ..... *H01B 7/182* (2013.01); *H01B 7/1875* (2013.01)

(58) Field of Classification Search
USPC ..... 174/102 R
See application file for complete search history.

(56) References Cited

U.S. PATENT DOCUMENTS 2,186,793 A * 1/1940 Wodtke ..... H01B 7/1895 156/55
2,320,313 A * 5/1943 Thomas ..... H01B 7/282 174/110 B
2,800,524 A * 7/1957 Van Lear ..... H01B 7/29 174/116
3,349,169 A * 10/1967 Donadieu ..... H01B 12/02 174/102 R
3,529,340 A * 9/1970 Brorein ..... H01B 11/1839 174/110 F
3,576,388 A * 4/1971 Bruns ..... H01B 3/28 174/110 F
4,025,715 A * 5/1977 Foley ..... H01B 9/027 174/108

(Continued)

*Primary Examiner* — William H Mayo, III
*Assistant Examiner* — Krystal Robinson
(74) *Attorney, Agent, or Firm* — Banner & Witcoff, Ltd.

(57) ABSTRACT

In general, aspects of this invention relate to electrical cables and, in particular, to a cable with electromagnetic and/or anti-ballistic shielding. According to one aspect, a cable may comprise: a conductor; a continuous metallic sheath surrounding the conductor; and a supplemental sheath layer surrounding the metallic sheath. According to another aspect, a cable may comprise: a conductor; an armor layer surrounding the conductor; a fabric layer surrounding the conductor; and a polymer layer surrounding the conductor. According to yet another aspect, a cable may comprise: a conductor; an inner synthetic strength member surrounding the conductor; a polymer compound positioned between the conductor and the inner synthetic strength member; a polymer layer surrounding the inner synthetic strength member; an armor layer surrounding the polymer layer; an outer synthetic strength member surrounding the armor layer; and a polyolefin layer surrounding the outer synthetic strength member.

12 Claims, 1 Drawing Sheet

(56) References Cited

U.S. PATENT DOCUMENTS

| | | | | | |
|---|---|---|---|---|---|
| 4,312,260 | A * | 1/1982 | Morieras | D07B 1/04 | 174/121 R |
| 4,894,488 | A * | 1/1990 | Gupta | C08J 9/12 | 156/51 |
| 5,043,530 | A * | 8/1991 | Davies | H01B 7/1895 | 174/102 R |
| 5,119,457 | A * | 6/1992 | Callahan | G02B 6/3817 | 174/79 |
| 5,220,130 | A * | 6/1993 | Walters | H01B 11/1839 | 174/113 R |
| 5,270,486 | A * | 12/1993 | Chan | H01B 7/0233 | 174/107 |
| 5,477,011 | A * | 12/1995 | Singles | H01B 11/1834 | 174/102 R |
| 6,028,975 | A * | 2/2000 | Davidson | G02B 6/4436 | 385/101 |
| 6,255,594 | B1 * | 7/2001 | Hudson | H01B 7/295 | 174/121 A |
| 6,326,551 | B1 * | 12/2001 | Adams | H01B 11/1804 | 174/113 C |
| 2003/0138628 | A1 * | 7/2003 | Castellani | H01B 3/22 | 428/375 |
| 2003/0164483 | A1 * | 9/2003 | Scelza | C08K 3/02 | 252/601 |
| 2005/0183878 | A1 * | 8/2005 | Herbort | H01B 11/1847 | 174/110 R |
| 2010/0186990 | A1 * | 7/2010 | Neuroth | H01B 7/045 | 174/120 AR |
| 2014/0262427 | A1 * | 9/2014 | Brown | H01B 3/301 | 174/113 C |

* cited by examiner

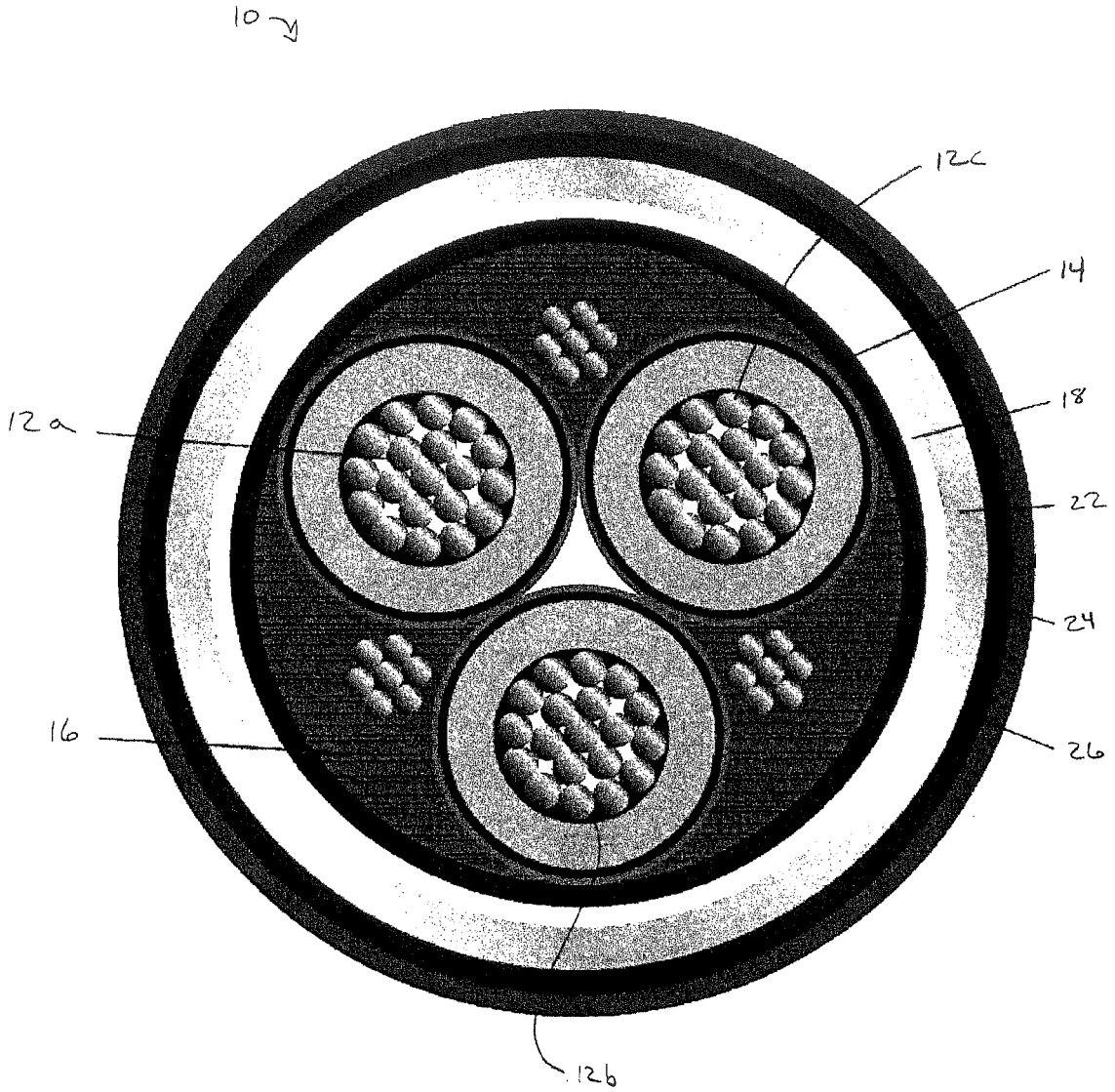
10
12c
14
18
12a
22
24
16
26
12b

ELECTROMAGNETIC AND ANTI-BALLISTIC SHIELD CABLE

RELATED APPLICATIONS

This present application claims the benefit to U.S. Patent Application No. 62/151,153 filed on Apr. 22, 2015 which is incorporated by reference herein and made a part hereof.

FIELD OF THE INVENTION

The present invention relates generally to electrical cables and, in particular, to a cable with electromagnetic and/or anti-ballistic shielding.

BACKGROUND

There are extensive publications detailing the concern over the effects of an electromagnetic pulse (EMP). In short, an electromagnetic pulse may generate a voltage and resulting current or signals in cables that may damage electronic equipment connected to the cables.

There is a large concern about a naturally occurring EMP from solar activity. One of the articles referred to the magnetic storms that occur naturally on the sun as being inevitable and not "if they would occur but when they would occur." Although written in 2008 the article goes on to say that we are currently entering a period of "increased solar activity". While the article does characterize the events as 100 year events they go on to report that major storms have occurred in 1859, 1921 and the 1989 storm that affected Hydro-Quebec shutting of power to 6 million customers.

There is also a large concern about the impact of a nuclear event, a device detonated high in the atmosphere—no blast, no radiation, no shock but a flood of electromagnetic fields. It is referred to as an HEMP attack (High Altitude Electromagnetic Pulse). Large areas of geography would be affected and have the same effect as the solar activity that occurs naturally but may be more pointed and focused. This type of attack is also called an IEMI (Intentional Electromagnetic Interference).

A subset of the IEMI (intentional interference) is the small man made magnetic pulse generators. These units can be small enough to actually fit in a suitcase, all be it that unit would have limited power, but the magazine Popular Science recently discussed how a pulse generator that could fit in a cargo van and powered by car batteries could be fashioned using readily available technology and parts and, in fact, a unit like this could be made to press the attack over a broad range of frequencies for extended time. This is a point of use device, which is particularly hazardous because, if it is found by the saboteur to be non-effective, the van or other vehicle carrying the device simply drives away with no one the wiser. The would-be saboteur is thus left to fight another day.

Since 1989 the European community recognized the threat and initiated research and publication of standards through the IEC (International Electro-Technical Commission)—this group has published an extensive set of standards and guidelines categorizing the various forms of EMP and defining the phenomena in engineering terms—organizing it for study and regulation. The standards cover General; Environmental (the electrical environment of the pulse); testing and measuring; installation guidelines; and generic standards for immunity.

In the United States, the organizing group has been the IEEE (Institute of Electrical and Electronic Engineers). The IEEE has a number of "sections'" including an EMC (Electromagnetic Compatibility) section. Many of the members that are involved in the IEC are also members and committee chairmen of the various IEEE/EMC working groups. The IEEE/EMC working groups have also published guidelines and technical papers on preparation, mitigation, etc.

An additional issue involves not the threat of magnetic fields from outside of a cable but rather a concern that the small magnetic fields associated with data signals that emanate from inside the cable can be "read" from the outside. This is a recognized security breach.

Furthermore, the recent attention to terrorist activities and the shooting activities at an electrical substation a number of years ago in California spurred the drive to design an electrical cable designed to specifically withstand a certain level of ballistic attack. It would be desirable for such an anti-ballistic cable to withstand one or more discharged rounds of a firearm.

A need exists for a cable that addresses at least some of the above issues.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

In general, aspects of this invention relate to electrical cables and, in particular, to a cable with electromagnetic and/or anti-ballistic shielding. According to one aspect, a cable may comprise: a conductor; a continuous metallic sheath surrounding the conductor; and a supplemental sheath layer surrounding the metallic sheath. The supplemental sheath layer may include a copper mesh material. The supplemental sheath layer may include aluminum polyester tape. The continuous metallic sheath may be made of a material selected from the group consisting of steel, aluminum and copper. The continuous metallic sheath may have a thickness ranging from 0.5 mm to 1.5 mm.

According to another aspect, a cable may comprise: a conductor; an armor layer surrounding the conductor; a fabric layer surrounding the conductor; and a polymer layer surrounding the conductor. The fabric layer may include a synthetic material. The armor layer may surround the synthetic material fabric layer. The cable may further comprise a polymer compound extruded between the conductor and the synthetic material fabric layer. The cable may also comprise a polymer layer surrounding the conductor. The cable may also further comprise a high-density polyolefin layer as an outer-most layer.

According to another aspect, a cable may comprise: a conductor; an inner synthetic strength member surrounding the conductor; a polymer compound positioned between the conductor and the inner synthetic strength member; a polymer layer surrounding the inner synthetic strength member; an armor layer surrounding the polymer layer; an outer synthetic strength member surrounding the armor layer; and a polyolefin layer surrounding the outer synthetic strength member. The polyolefin layer may be a high-density polyolefin. The polymer compound between the conductor and the inner synthetic strength member may be extruded.

BRIEF DESCRIPTION OF THE DRAWINGS

A more complete understanding of the present invention and certain advantages thereof may be acquired by referring to the following detailed description in consideration with the accompanying drawings, in which:

FIG. 1 is a cross-sectional view of an embodiment of the cable of the present invention.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example adjustment members, golf club heads, and golf club structures in accordance with the invention. Additionally, it is to be understood that other specific arrangements of parts and structures may be utilized, and structural and functional modifications may be made without departing from the scope of the present invention. Nothing in this specification should be construed as requiring a specific three dimensional or spatial orientation of structures in order to fall within the scope of this invention.

For anti-ballistic capability, the design of the cable depends on a layering of different impact absorbing materials including, but not limited to armor (aluminum or steel), energy absorbing fabric and energy absorbing homogeneous or foamed layers of various polymers. The materials are laid up in various combinations and permutations including, but not limited to, those illustrated and described below.

An embodiment of the cable of the present invention is indicated in general at 10 in FIG. 1. In the embodiment of FIG. 1, three bundles of power conductors 12*a*, 12*b* and 12*c* are surrounded by an inner synthetic strength member 14. It is to be understood that while three power conductor bundles 12*a*, 12*b* and 12*c* are illustrated, the cable may include a larger or smaller number of cables and the bundle(s) of power conductors may include a number of individual wires different from the number illustrated. The spaces between the power conductor bundles 12*a*, 12*b* and 12*c* and the synthetic case member is filled with an extended polymer compound 16. A polymer layer 18 surrounds the synthetic case member. An armor layer 22, which is preferably steel, aluminum or copper, is encased between the polymer layer 18 and an outer synthetic strength member 24. The inner and outer synthetic case members 14 and 24 may be constructed from, as examples only, Kevlar. An outermost layer 26 is preferably constructed from a high-density polyolefin.

The order and number of layers presented in FIG. 1 may be varied.

In addition to, or alternatively, embodiments of cable systems of the present invention are designed to mitigate or eliminate the transfer of magnetic fields in either direction with respect to the cable core. In other words, the cables are electromagnetic pulse (EMP) shielded.

In accordance with some embodiments of the present invention, a cable system (cable, fitting, accessories and preparation) provides proper electromagnetic pulse (EMP) shielding without joints, seams or cracks that would otherwise allow the propagation of magnetic fields. In addition, some embodiments provide proper grounding to allow any induced signal a low resistance path to ground.

In some embodiments, the cable is completely covered in a continuous sheath of metal, such as armor layer 22 of FIG. 1. The sheath is continuous in that it is without joints, seams or cracks. In addition, the sheath is of substantial thickness for cable integrity and to provide enough cross sectional area to provide a low resistance path to ground. As an example only, the sheath may be 0.5 mm to 1.5 mm thick. The cable is terminated with a connector that provides 360 degree grounding to the sheath and the connection shall be made with a special conductive paste to enhance the grounding affects.

In alternative embodiments, the cable may include an additional or supplemental sheath layer (in addition to armor layer 22) over the core of the cable made of a material such as, for example, copper mesh or aluminum polyester tape.

While the preferred embodiments of the invention have been shown and described, it will be apparent to those skilled in the art that changes and modifications may be made therein without departing from the spirit of the invention.

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

I claim:

1. A cable comprising:

a. one or more conductors surrounded by an inner synthetic strength member, wherein the one or more conductors and the inner synthetic strength member define a plurality of interstitial spaces located between the one or more conductors, wherein an extended polymer compound is extruded to fill the plurality of interstitial spaces between the one or more conductors and the inner synthetic strength member;

b. a continuous metallic armor sheath surrounding the inner synthetic strength member and the one or more conductors, wherein the extended polymer compound provides energy absorbing homogeneous foamed layers of various polymers to the cable; and c. an outer synthetic strength layer surrounding the metallic sheath, the inner synthetic strength member and the outer synthetic strength layer made of an anti-ballistic material, wherein the cable with the layering of the continuous metallic armor sheath, the energy absorbing inner synthetic strength member and outer synthetic strength layer, and the energy absorbing homogeneous foamed layers of various polymers provide electromagnetic shielding without joints, seams, or cracks that would otherwise allow propagation of magnetic fields to withstand an electromagnetic pulse and an anti-ballistic shielding to withstand one or more discharged rounds of a firearm.

2. The cable of claim 1, wherein the outer synthetic strength layer includes a copper mesh material.

3. The cable of claim 1, wherein the outer synthetic strength layer includes aluminum polyester tape.

4. The cable of claim 1, wherein the continuous metallic armor sheath is made of a material selected from the group consisting of steel, aluminum and copper.

5. The cable of claim 1 wherein the continuous metallic armor sheath has a thickness ranging from 0.5 mm to 1.5 mm.

6. A cable comprising:

a. one or more conductors surrounded by an inner synthetic strength member, wherein the one or more conductors and the inner synthetic strength member define a plurality of interstitial spaces located between the one or more conductors, wherein an extended polymer compound is extruded to fill the plurality of interstitial spaces between the one or more conductors and the inner synthetic strength member;

b. an armor layer surrounding the inner synthetic strength member and the one or more conductors, wherein the extended polymer compound provides energy absorbing homogeneous foamed layers of various polymers to the cable;

c. a synthetic fabric strength layer surrounding the armor layer, the inner synthetic strength member and the synthetic fabric strength layer made of an anti-ballistic material; and d. a polymer layer surrounding the inner synthetic strength member, wherein the cable with the layering of the armor layer, the energy absorbing inner synthetic strength member and synthetic fabric strength layer, and the energy absorbing homogeneous foamed layers of various polymers provide electromagnetic shielding without joints, seams, or cracks that would otherwise allow propagation of magnetic fields to withstand an electromagnetic pulse and an anti-ballistic shielding to withstand one or more discharged rounds of a firearm.

7. The cable of claim 6 , wherein the armor layer surrounds the inner synthetic strength member material fabric layer.

8. The cable of claim 7 wherein the polymer compound is extruded between the one or more conductors and the inner synthetic strength member.

9. The cable of claim 7 further comprising a high-density polyolefin layer as an outer-most layer, wherein the one or more conductors and the inner synthetic strength member define a plurality of interstitial spaces located between the one or more conductors, wherein an extended polymer compound is extruded to fill the plurality of interstitial spaces between the one or more conductors and the inner synthetic strength member.

10. A cable comprising:

a. one or more conductors;

b. an inner synthetic strength member surrounding the one or more conductors, wherein the one or more conductors and the inner synthetic strength member define a plurality of interstitial spaces located between the one or more conductors;

c. an extended polymer compound extruded to fill the plurality of interstitial spaces between the one or more conductors and the inner synthetic strength member, wherein the extended polymer compound provides energy absorbing homogeneous foamed layers of various polymers to the cable;

d. a polymer layer surrounding the inner synthetic strength member;

e. an armor layer surrounding the polymer layer;

f. an outer synthetic strength member surrounding the armor layer, the inner synthetic strength member and the outer synthetic strength member made of an anti-ballistic material; and g. a polyolefin layer surrounding the outer synthetic strength member, wherein the cable with the layering of the armor layer, the energy absorbing inner synthetic strength member and outer synthetic strength member, and the energy absorbing homogeneous foamed layers of various polymers provide electromagnetic shielding without joints, seams, or cracks that would otherwise allow propagation of magnetic fields to withstand an electromagnetic pulse and an anti-ballistic shielding to withstand one or more discharged rounds of a firearm.

11. The cable of claim 10, wherein the polyolefin layer is a high-density polyolefin.

12. The cable of claim 10, wherein the polymer compound between the one or more conductors and the inner synthetic strength member is extruded.

* * * * *